US009358565B1

(12) United States Patent
Mizioch et al.

(10) Patent No.: US 9,358,565 B1
(45) Date of Patent: Jun. 7, 2016

(54) MARKING DEVICE

(71) Applicant: Ideas Brought to Life, LLC, Phoenix, AZ (US)

(72) Inventors: Gregory J. Mizioch, Scottsdale, AZ (US); John A. Gillam, Glendale, AZ (US); Rachel L. Mizioch Foss, Phoenix, AZ (US)

(73) Assignee: Ideas Brought to Life, LLC, Phoenix, AZ (US)

( * ) Notice: Subject to any disclaimer, the term of this patent is extended or adjusted under 35 U.S.C. 154(b) by 5 days.

(21) Appl. No.: 14/483,951

(22) Filed: Sep. 11, 2014

Related U.S. Application Data

(60) Provisional application No. 61/876,978, filed on Sep. 12, 2013.

(51) Int. Cl.
*B05B 3/00* (2006.01)
*B05B 15/06* (2006.01)

(52) U.S. Cl.
CPC ..... *B05B 15/062* (2013.01)

(58) Field of Classification Search
USPC ..... 118/321, 323; 222/162, 174, 175, 222/470–473; 239/150, 151, 273, 280, 532, 239/754; 346/140.1–143; 427/136, 137
See application file for complete search history.

(56) References Cited

U.S. PATENT DOCUMENTS 2,567,733 A * 9/1951 Ryan ..... B43L 9/24 33/27.02
3,871,557 A 3/1975 Smrt
4,262,821 A 4/1981 Smrt
4,599,968 A 7/1986 Ryder et al.
4,641,780 A 2/1987 Smrt
4,843,719 A * 7/1989 Straten ..... B43L 9/04 33/27.02
5,148,988 A 9/1992 Smrt
5,287,998 A 2/1994 Smrt
5,411,184 A 5/1995 Smrt
5,785,214 A 7/1998 Smrt
5,918,565 A * 7/1999 Casas ..... G01C 15/02 116/209
6,102,305 A 8/2000 Chapman et al.
6,390,336 B1 * 5/2002 Orozco ..... B05B 15/061 222/162
6,435,129 B1 8/2002 McDonald et al.
6,551,001 B2 4/2003 Aberegg et al.
6,663,307 B2 12/2003 Kopanic et al.
7,175,106 B2 2/2007 Roman (Continued)

FOREIGN PATENT DOCUMENTS

EP 1425235 2/2003

*Primary Examiner* — Yewebdar Tadesse
(74) *Attorney, Agent, or Firm* — Cahill Glazer PLC

(57) ABSTRACT

A marking device incorporates a pair of legs secured at one end to each other for pivotal movement with respect to each other and wherein one of the legs includes a pivot member for positioning at a pivot point located on a surface to be marked. A weight is secured to the other of said legs for contacting the surface and wherein a paint can retainer is positioned at that end of the leg for receiving a spray paint can. A hinge is secured between the paint can retainer and the leg to permit pivotal movement between the paint can retainer, the spray paint can contained therein, and a marking cane secured to said paint can retainer and paint can. A pivoting support rod is attached to the marking cane and one of the legs of the marking device and a spacer bar is pivotally secured between the two legs of the device wherein the two legs may be pivoted towards each other and the marking cane may be pivoted toward the legs to provide a collapsed marking device for convenient transportation and storage.

4 Claims, 2 Drawing Sheets

(56) References Cited

U.S. PATENT DOCUMENTS

| | | | |
|---|---|---|---|
| 7,419,104 | B2 | 9/2008 | Roman |
| 7,770,819 | B2 | 8/2010 | Yu Chen |
| 7,966,740 | B2 | 6/2011 | Knudsen |
| 8,060,304 | B2 | 11/2011 | Nielsen et al. |

* cited by examiner

MARKING DEVICE

RELATED APPLICATION

This application is related to and claims priority to a provisional application entitled "MARKING DEVICE" filed Sep. 12, 2014, and assigned Ser. No. 61/876,978.

FIELD OF THE INVENTION

The present invention is directed to apparatus for creating a circle with marking material such as spray paint wherein the circle is produced by rotating a dispenser of marking material about a center point to thus produce an essentially perfect circle about the center point to indicate, for example, the exact size and location of a proposed access opening in the ground such as a manhole for access to utilities and the like.

BACKGROUND OF THE INVENTION

Providing the location of a manhole for access to utilities located underground usually requires the location of the precise point representing the center of an excavation to be transformed into the manhole. The size of the manhole (cylindrical with a predetermined diameter) is predetermined and the center of the proposed manhole is located. A circular marking is then provided as a guide for subsequent excavation and for planning layouts and locations of such excavations. The marking is usually executed by a workman anchoring a flexible tape (such as a flexible rule) or a chord to the center point of the proposed excavation and then progressively marking (with spray paint for example) points circumscribing the center point thus resulting in a circular marking on the ground or other working surface.

SUMMARY OF THE INVENTION

The present invention provides a collapsible marking compass that incorporates pivoting legs, a pivot member to be located at the desired excavation center, and a spray paint or aerosol can holder hinged to a second leg that also includes a wheel secured thereto. A marking cane connects the paint can holder to a handle positioned to be conveniently grasped by an operator and includes a spray actuating trigger. The marking cane and spray paint can holder pivot about the hinge and are secured in place by a pivoting rod pivotally attached to the marking cane and one of the legs. The diameter of the prospective circle is determined by the adjustment of a spacer bar pivotally connected to one of the compass' legs and adjustably and releasably secured to a second leg to thereby fix the distance at a selected value for a chosen diameter of the subsequently created circular mark on the working surface. The operator may then conveniently place the pivot member at the desired center point, select the appropriate positioning of the spacer bar (at the desired chosen diameter of the circle), and place the wheel in contact with the ground. The handle is grasped by the operator and the spray actuating trigger is depressed. The operator may then simply walk about the pivot point while depressing the spray actuating trigger and maintaining the wheel in contact with the ground to thus produce an accurately positioned and accurately sized circular marking.

BRIEF DESCRIPTION OF THE DRAWINGS

The present invention may more readily be described by reference to the accompanying drawings in which.

DETAILED DESCRIPTION OF THE INVENTION

Figure 1:
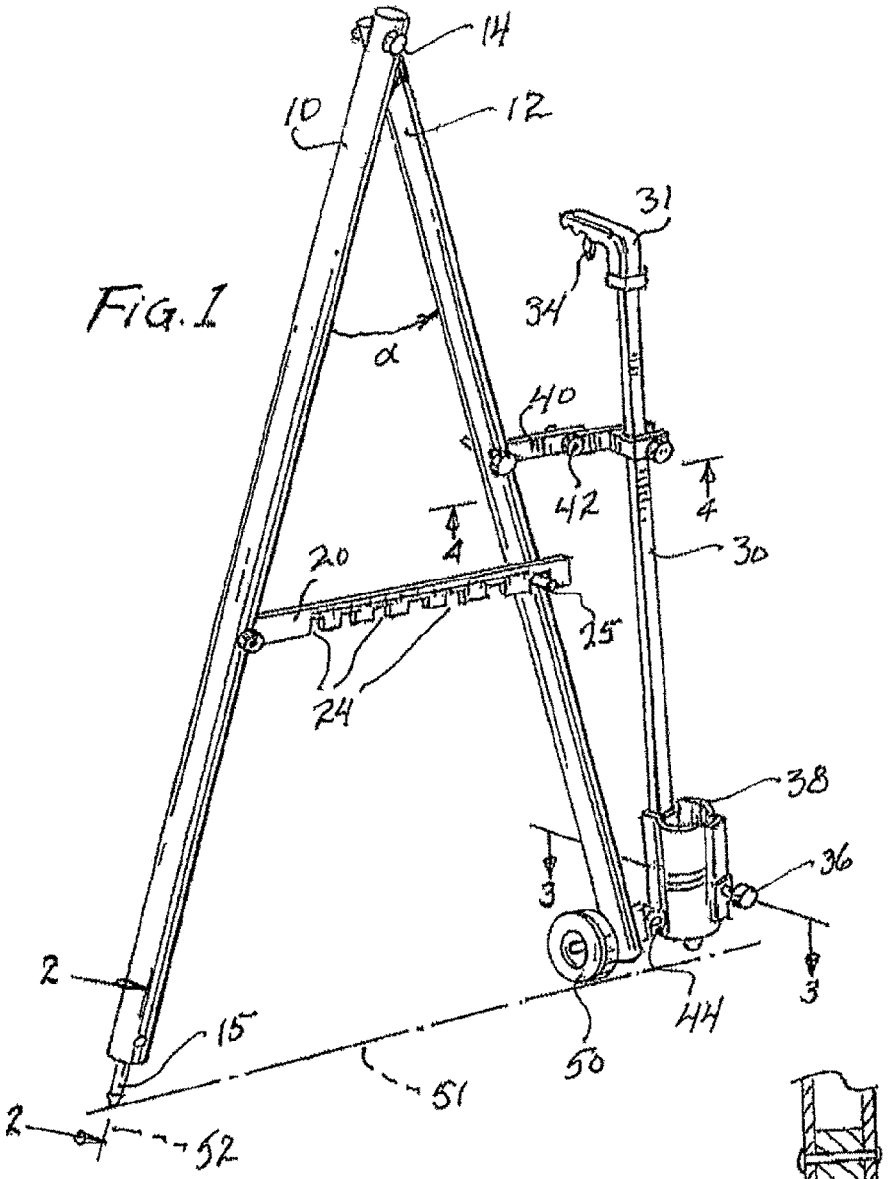
FIG. 1 is an illustration of a marking device incorporating the teachings of the present invention.
Figure 2:
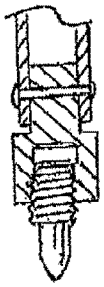
FIG. 2 is a cross-sectional view of a portion of FIG. 1 showing the attachment of the pivot member to one of the marking device legs.
Figure 3:
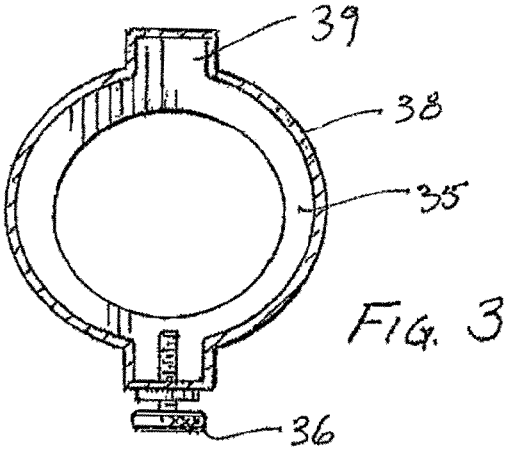
FIG. 3 is a cross-sectional view of a portion of FIG. 1 taking along line 3-3.

Referring to the figures, the marking device includes a first leg 10 and a second leg 12 that are mounted to permit relative pivotal motion with respect to each other and may be pivotally hinged together at one end thereof 14, respectively, to permit relative rotation between the legs. The legs are rigid elongated members such as extruded aluminum tubing. The first leg 10 is provided with a pivot member 15 for positioning on a surface to be marked and may be a pointed stub or shaft for penetrating a soil surface; alternatively, the pivot member may be covered by, or be replaced by, a rubber shroud or cap to cover the pivoting end to facilitate positioning the pivot member on a hard surface such as concrete, macadam or flooring if the marking compass is to be used indoors. The angle $\alpha$ between the first and second leg, and therefore the diameter of the circle to be marked, is determined by the positioning of a spacer bar 20 that is pivotally secured to the first leg 10 and releasably attached to the second leg by incorporating a plurality of notches 24 for engaging a latch pin 25 mounted on the second leg 12. The position of the notches 24 on the spacer bar 20 may be predetermined to provide standardized circle diameters commonly encountered when using the device of the present invention. Further, indicia 26 may be placed on the spacer bar 20 adjacent the respective notches 24 to indicate the diameter of the circle when a specific notch is chosen to engage the latch pin 25. For example, when the markings are created representing standardized manhole diameters, the notches may be chosen so that a selected standardized manhole size may be chosen without requiring the operator to accurately measure the forthcoming diameter. The spacer bar may also be provided with a sliding scale or other spacing indicia to supplement the predetermined notch locations in the event the diameter of the forthcoming circle is a non-standard diameter.

Figure 5:
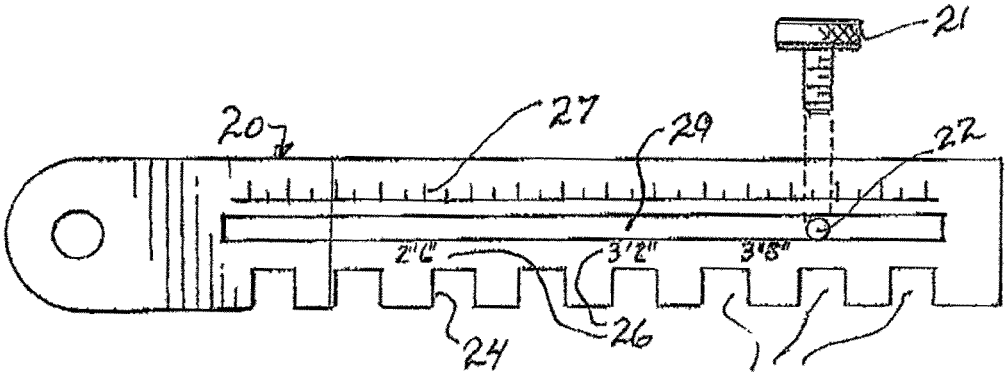
FIG. 5 is an enlarged view of the spacer bar of FIG. 1.

Referring to FIG. 5, an alternative spacer bar 20 is shown wherein notches 24 are provided as described above; however, the alternative spacer bar incorporates a slot 29 and a sliding scale 27 that can be positioned and secured in place by a spacer bar locking screw 21. That is, rather than orient a particular notch 24 with a latch pin 25 located in the second leg, the sliding scale may be utilized to select a chosen diameter in accordance with the scale and the position of the spacer bar locked by threading a spacer bar locking screw 21 through the slot 29 into a threaded hole 22 provided in the second leg 12. In this manner, any chosen diameter may be selected for circumscribing a chosen circle having the desired size.

A marking cane 30 is provided and may be a hollow rectangular aluminum extrusion housing an operating rod connected to a trigger 34 to actuate a spray paint can mounted in the paint can retainer 38 to emit an appropriate paint spray. The marking cane 30 includes a handle 31 at one end thereof and a spray activating trigger 34 positioned adjacent the handle to permit the operator to grasp the handle and depress the spray actuating trigger 34. Marking canes, sometimes referred to as marking wands or striping sticks are well known in the art and need not be described here. Such devices usually include a handle with a trigger, operable by the operator's finger, that connects to an operating rod to actuate the aerosol spray nozzle. A spray paint can is positioned within a can retainer 38 and may be locked into position in a convenient manner such as by thumb screw 36. Operation of the spray activating trigger 34 actuates the spray nozzle paint can in a well known manner to permit the emission of spray paint from the spray nozzle. The paint can retainer 38 includes a channel 39 for receiving the marking cane 30 and includes a ledge 35 for positioning and supporting a paint can when inserted in the retainer 38.

Figure 4:
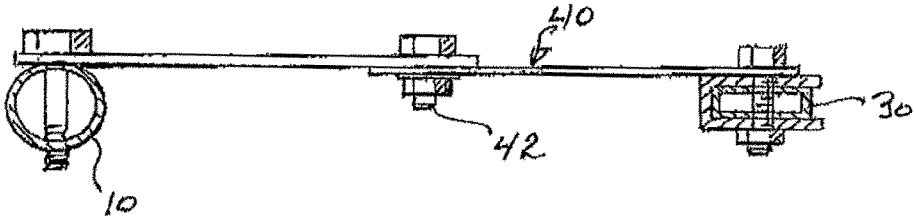
FIG. 4 is a top view, partly in section of the support rod of the marking device of the present invention.

The marking cane 30 is secured to the second leg 12 through the utilization of a pivoting support rod 40 that is collapsible about a generally centrally located pivot 42 and is lockable in its extended position as shown in FIG. 1 and FIG. 4 such as by tightening the pivot bolt 41. When locked in its extended position, a predetermined angular position is established between the marking cane and the second leg. Similarly, the paint can retainer 38 is secured to the second leg 12 with a hinge or pivot 44 to permit rotation of the paint can retainer about the hinge toward and away from the second leg 12. When the apparatus is not in use, the spacer bar 20 is disengaged from the latch pin 25 on the second leg and pivoted to a substantially parallel position with the first leg. Similarly, the marking cane 30 is moved to a position parallel to the second leg 12 by folding the support rod 40 about its central pivot 42 and swinging the marking cane 30 about the hinge 44 that connects to the paint can retainer 38 to the second leg 12. The first and second legs 10 and 12, respectively, are then rotated until they are substantially parallel to each other.

A wheel 50 is secured at the bottom of the second leg, in the preferred embodiment, it is secured to the bottom of the second leg 12, or may alternatively be secured to the spray can retainer 38, and is mounted to rotate in contact with the ground, or other surface to be marked, about the radius 51 intersecting the longitudinal axis 52 of the first leg 10. In use, the pivot member 15 is located at the center of the circle to be marked while the operator grasps the handle 31 and depresses the spray actuating trigger 34. The operator then walks about the pivot member 15 with the wheel 50 engaging the surface to be marked. As the operator proceeds about the pivot member 15, the wheel 50 rotates in contact with the surface while the apparatus is being moved by the operator. The result is a spray paint marking circumscribing the position of the pivot member 15 having a chosen diameter determined by the selection of the appropriate notch 24 engaging the latch pin 25. When the procedure is completed, and as described above, the spacer bar 20 is disengaged from the latch pin and pivoted to a position parallel with the first leg 10; the marking cane 30 is pivoted about the hinge 44 to assume a position parallel to the second leg 12. The first and second legs are then pivoted with respect to each other to assume parallel positions with respect to each other. The apparatus is thus conveniently collapsed into a readily portable configuration to thus occupy a minimum of space during transport.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A marking device comprising:

(a) a first leg and a second leg secured at a first end of each leg for pivotal movement with respect to each other;

(b) a pivot member secured to a second end of said first leg for positioning at a pivot point located on a surface to be marked;

(c) a wheel secured at a second end of said second leg for contacting said surface;

(d) a paint can retainer positioned at the second end of said second leg;

(e) a hinge secured to the second end of said second leg and attached to said paint can retainer to permit rotation of the paint can retainer about the hinge toward and away from the second leg;

(f) said paint can retainer having a channel for receiving a marking cane;

(g) a marking cane positioned in said channel and extending therefrom;

(h) a pivoting support rod attached to said marking cane and said second leg to establish a predetermined angular position between the marking cane and the second leg and permit the marking cane to be rotated about said hinge; and (i) a spacer bar pivotally secured to one of said first and second legs and releasably attached to the other of said legs for establishing a selected angle between said legs and permit said legs to pivot towards each other when said spacer bar is released from said other of said legs.

2. The marking device of claim 1 wherein said wheel is secured to a second end of the second leg.

3. The marking device of claim 1 wherein said legs are rigid, elongated, aluminum extrusions.

4. The marking device of claim 1 wherein said wheel is secured at a second end of the second leg and attached to said paint can receiver.

* * * * *